US007071895B2

(12) United States Patent
Wampler

(10) Patent No.: US 7,071,895 B2
(45) Date of Patent: Jul. 4, 2006

(54) PSEUDO BIT-DEPTH SYSTEM FOR DYNAMIC BILLBOARDS

(75) Inventor: Scott D. Wampler, West Chester, OH (US)

(73) Assignee: Novus Communication Technologies, Inc., Cincinnati, OH (US)

( * ) Notice: Subject to any disclaimer, the term of this patent is extended or adjusted under 35 U.S.C. 154(b) by 423 days.

(21) Appl. No.: 10/422,331

(22) Filed: Apr. 24, 2003

(65) Prior Publication Data

US 2004/0035036 A1 Feb. 26, 2004

Related U.S. Application Data

(60) Provisional application No. 60/405,152, filed on Aug. 22, 2002.

(51) Int. Cl.
*G06G 5/00* (2006.01)

(52) U.S. Cl. ..... 345/1.1; 345/107; 345/694

(58) Field of Classification Search ..... 345/2.1, 345/2.3, 204, 426, 1.1, 107, 694, 695; 40/446, 40/624; 705/1, 14, 26
See application file for complete search history.

(56) References Cited

U.S. PATENT DOCUMENTS

| | | | | |
|---|---|---|---|---|
| 4,126,854 | A | 11/1978 | Sheridon | |
| 4,761,641 | A | 8/1988 | Schreiber | |
| 5,612,741 | A | 3/1997 | Loban et al. | |
| 5,739,808 | A * | 4/1998 | Suga et al. | 345/89 |
| 6,120,588 | A | 9/2000 | Jacobson | |
| 6,172,798 | B1 * | 1/2001 | Albert et al. | 359/296 |
| 6,424,998 | B1 | 7/2002 | Hunter | |
| 6,430,603 | B1 | 8/2002 | Hunter | |
| 6,430,605 | B1 * | 8/2002 | Hunter | 709/207 |
| 6,538,801 | B1 * | 3/2003 | Jacobson et al. | 359/296 |
| 6,864,875 | B1 * | 3/2005 | Drzaic et al. | 345/107 |
| 2002/0087335 | A1 * | 7/2002 | Meyers et al. | 705/1 |
| 2002/0097193 | A1 * | 7/2002 | Powers | 345/2.3 |
| 2003/0001796 | A1 * | 1/2003 | Wampler et al. | 345/2.1 |
| 2003/0001830 | A1 * | 1/2003 | Wampler et al. | 345/204 |
| 2003/0004805 | A1 * | 1/2003 | Vaitekunas et al. | 705/14 |
| 2003/0004806 | A1 * | 1/2003 | Vaitekunas | 705/14 |

FOREIGN PATENT DOCUMENTS

| | | |
|---|---|---|
| WO | WO/00/52935 | 9/2000 |
| WO | WO/00/65576 | 11/2000 |

* cited by examiner

*Primary Examiner*—Jimmy H. Nguyen
(74) *Attorney, Agent, or Firm*—Frost Brown Todd LLC

(57) ABSTRACT

A dynamic device for billboard advertising is disclosed. An advertising billboard device in accordance with the present invention comprises a display controller adapted to receive and display dynamic-content. At least one content display unit is in communication with the display controller, wherein the content display unit visually displays the information from the dynamic-content. Dynamic content having a bit-depth greater than the bit-depth of the content display unit is parsed into sub-pixels for display on the content display unit. The combination of sub-pixels, when viewed, appears to have a bit-depth greater than the bit-depth of the content display unit material.

20 Claims, 9 Drawing Sheets

PSEUDO BIT-DEPTH SYSTEM FOR DYNAMIC BILLBOARDS

This application is related to, and claims the benefit of, U.S. provisional application Ser. No. 60/405,152 filed Aug. 22, 2002.

FIELD OF THE INVENTION

The present invention relates, in general, to advertising billboard devices and, more particularly, to content display units capable of dynamic-content presentation with pseudo bit-depth.

BACKGROUND OF THE INVENTION

Billboards are used to display various messages typically consisting of a combination of text and graphics. Traditionally, the message has been provided by way of fixed sheets that are pasted to a backing. This traditional approach suffers from the inability to quickly change the displayed message since it requires the use of a crew to change the message. Electronic billboards provide the advantage in that it is easier to change the displayed message. Electronic billboards include the dot matrix type utilizing many individual bulbs. Within stadiums, arenas and auditoriums there presently are electronic dot matrix display devices used for instant replays, advertising and customer information. While these electronic billboards are easily changed, they are difficult to manage and often require significant support resources to coordinate billboard content.

Loban et al. disclose a video billboard including a remote computer control with radio communications to the billboard display in U.S. Pat. No. 5,612,741 ('741). The '741patent discloses that display information is communicated from a master computer to a receiver in the billboard housing which, in turn, controls the light valve display of the '741invention. Commands may also be communicated via shared or dedicated landlines. The '741billboard is capable of providing complex video graphics with high contrast ratios. It can provide message changes on command through landline, cellular phone, satellite relay or other wireless communication links. Within the commercial advertising billboard industry it will allow the use of computer video control to change graphics easily and quickly, as desired. Advertisements, public service announcements or traffic conditions can be displayed in near real time from remote locations since images can be downloaded via the communication links and displayed at pre-programmed time slots, if desired.

Gofman et al. disclose a system and method for serving local and global media content in PCT publication WO 00/52935 ('52935). The '52935 publication discloses a system and method for combining broadcast media content with additional content at a local site according to at least one locally determined characteristic of the audience to which the combined content is served. The '52935 publication discloses a template containing information concerning the type of data objects to be displayed, their size and location on the display, as well as the timing of display and transitions to the display, such that the template describes how to process and display the data.

New display materials are being developed that have the potential to expand advertising billboard technology, such as, for example, GYRICON a trade name of Xerox Corporation, Palo Alto Research Center, Palo Alto Calif. These new materials have the potential to expand the capabilities of billboard displays. Another new material for displays is E-INK, a trade name of E Ink Corporation 733 Concord Avenue, Cambridge, Mass. GYRICON technology is disclosed, for example, in U.S. Pat. No. 4,126,854. E-INK technology is disclosed, for example, in U.S. Pat. No. 6,120,588.

Although significant improvements are expanding the capabilities of new display materials, many forms of the material are limited in the bit-depth of available colors. For example, the simplest form of the GYRICON material is only one bit deep in color, i.e. black or white. It would therefore be advantageous to provide an improved billboard advertising device providing apparent full-color display with limited bit-depth materials. It would further be advantageous to provide an advertising device that easily controls multiple combinations of content display units. It would also be advantageous to provide easily manageable dynamic display content

SUMMARY OF THE INVENTION

A dynamic device for billboard advertising is disclosed. An advertising billboard device in accordance with the present invention comprises a display controller adapted to receive and display dynamic-content. At least one content display unit is in communication with the display controller, wherein the content display unit visually displays the information from the dynamic-content. Dynamic content having a bit-depth greater than the bit-depth of the content display unit is parsed into sub-pixels for display on the content display unit. The combination of sub-pixels, when viewed, appears to have a bit-depth greater than the bit-depth of the content display unit material.

BRIEF DESCRIPTION OF THE DRAWINGS

The novel features of the invention are set forth with particularity in the appended claims. The invention itself, however, both as to organization and methods of operation, together with further objects and advantages thereof, may best be understood by reference to the following description, taken in conjunction with the accompanying drawings in which:

DETAILED DESCRIPTION OF THE INVENTION

Figure 1:
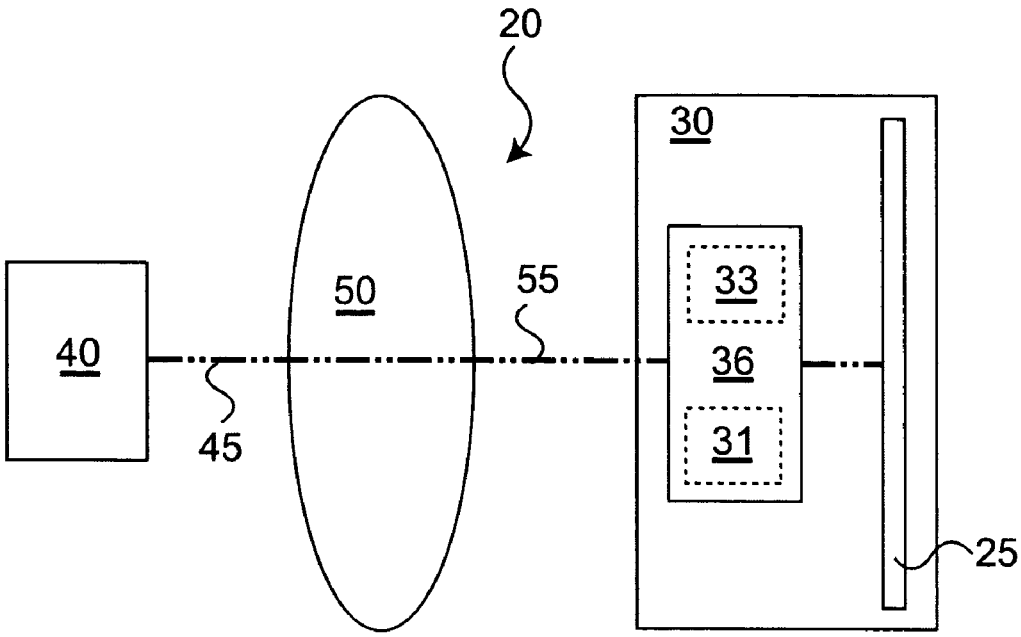
FIG. 1 is a block diagram of an advertising billboard system in accordance with the present invention.

The present invention relates, in general, to advertising billboard devices and, more particularly, content display units capable of dynamic-content presentation with pseudo bit-depth.

Content-display units are herein defined to include any visual display or portion of display capable of displaying information from dynamic-content such as, for example, video billboards, GYRICON, E-Ink, computer monitors, shopping mall kiosks, stadium displays, personal digital assistants, movie-theater screens, video projectors, and cellular phone displays. Content display units are divided into two types, active content-display units and passive content-display units. Active content-display units are displays that only display dynamic-content when they are actively being addressed or written on, such as, for example, computer monitors, movie-theater screens, and L.E.D. displays. Passive content-display units are displays that, when not being actively written to or addressed, retain a viewable image such as, for example, GYRICON and E-INK.

A suitable material for a passive content-display media would be, for example, SMARTPAPER (Trademark of Gyricon Inc. Palo Alto, Calif.) technology using an array of tiny (100 micron diameter or smaller) solid beads with one hemisphere of each bead one color (e.g. white) and the other a different color (e.g. black). This combination corresponds to a bit-depth of one, where, for example, a binary 0 corresponds to black and a binary 1 corresponds to white. These beads are embedded in a flexible plastic sheet in small cavities surrounded by a liquid. Each bead carries an electrical charge. When an external electric field is applied the bead rotates or gyrates. Adhesive forces between each bead and cavity wall require an electrical threshold be exceeded before it will rotate. This makes an image electrically "printed" onto the material stable and unchanging until "erased" by another transmission.

Electrical signals can be applied to the SMARTPAPER sheets through fixed surface electrodes or a moving stylus. A networked programmable sign will run for up to 2 years on 3 AA batteries, with the power almost completely used by the communications and processing systems. SMARTPAPER itself requires just a capacitance or voltage (about 100 volts), not a power current. Unlike other types of electronic displays, SMARTPAPER has a wide viewing angle identical to traditional printed signs. This allows SMARTPAPER to be viewed like paper, from all angles and without added backlighting. Images can currently be displayed on SMARTPAPER with resolution over 100 dpi. Applying electrical fields to the display surface changes the image on SMARTPAPER. For purposes herein, GYRICON and SMARTPAPER are synonymous.

Dynamic-content is herein defined as information or data to be visually displayed that is updatable or changeable by electronic control such as, for example, pixel data from a digitized image, analog beam modulation information for a cathode ray tube (CRT), streaming video over a network, and ASCII character codes.

FIG. 1 is a block diagram of an advertising billboard system 20 in accordance with the present invention. Advertising billboard system 20 comprises a server 40 and a display controller 30 adapted to receive, store, and display a dynamic-content from the server 40. Display controller 30 includes at least one content display unit 25, a receiver 36, storage means 33, and may include a timing means 31. Dynamic-content is transmitted from server 40 on a transmission path 45, through transmission media 50, and on receiving path 55 to display controller 30. Transmission path 45, transmission media 50, and receiving path 55 may be any one or combination of data transfer such as, for example, telephone wire, internet link, radio communication, cellular telephony, microwave link, local area network, and satellite broadcast. Receiver 36 receives the dynamic-content where it is either stored in storage means 33, or displayed on content display unit 25. Storage means 33 may be, for example, dynamic RAM in a computer, video tape, display memory, and computer hard disk.

The content display unit 25 visually displays the information from the dynamic-content. The timing means 31 may be, for example, a clock, a Global Positioning System (GPS), timing trigger, or other means of detecting a timing event. The display controller 30 alters the visual display of the content display unit 25 as a function of the time or position from the timing means 31. For example, if content display unit 25 is located near a commuter highway visible to commuters, it may be desirable to display a first message on content display unit 25 during commuter rush hours, and to display a second different message on content display unit 25 at other times.

Content-display unit 25 may be located, for example, on the side of a semi-trailer travelling over the road within a city. It may be desirable to display a first message whenever the semi-trailer is within a defined area, and a second message whenever the semi-trailer is outside of a defined area. It is contemplated that, for example, within the boundaries of an acceptable travelling range a first message could indicate trailer contents, and outside the acceptable travelling range a second message could indicate that the trailer should be stopped. As a second example, whenever a trailer having a content-display unit 25 is within a defined distance from "JOE's", it may be desirable to display "EAT at JOE's" on display unit 25.

Figure 2:
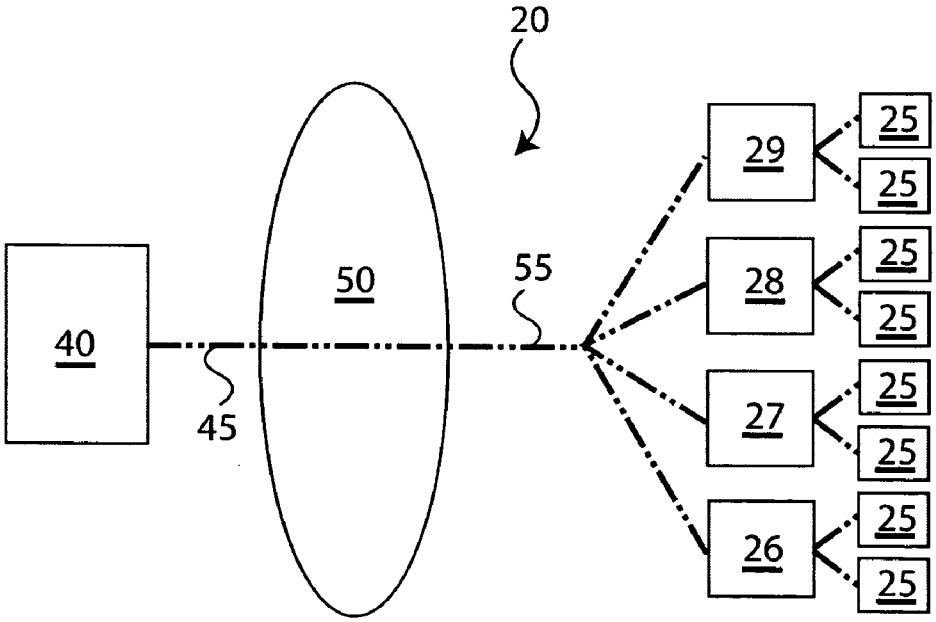
FIG. 2 is a block diagram of an advertising billboard system including a plurality of content display units in accordance with the present invention.

FIG. 2 is a block diagram of advertising billboard system 20 including a plurality of content display units 25 in accordance with the present invention. The advertising billboard system 20 may also comprise a plurality of display controllers 26, 27, 28, 29 in communication with a plurality of content display units 25, each one from the plurality of display controllers 26, 27, 28, 29 having a type identifier, wherein each of the display controllers 26, 27, 28, 29 selects dynamic-content for display on its content display unit 25 as a function of its type identifier. For example, display controller 26 may have a type identifier of highway billboard, display controller 27 may have a type identifier of shopping mall kiosk, display controller 28 may have a type identifier of computer monitors on a local area network, and display controller 29 may have a type identifier of an individuals cell phone display.

Figure 3:
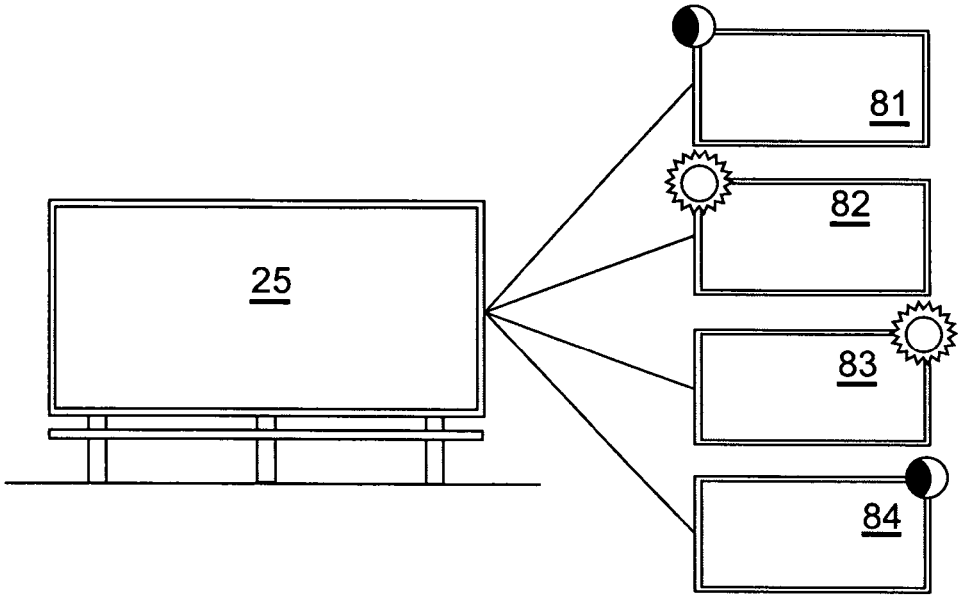
FIG. 3 is a block diagram of an advertising billboard device in accordance with the present invention.

FIG. 3 is a block diagram of a content display unit 25 in accordance with the present invention. Content display unit 25 may display dynamic-content that changes over time such as, for example, video, image morphing, sequential messages, or discrete time periods of static image. FIG. 3 illustrates an example of discrete time periods of static image. An image 81 may be displayed on content display unit 25 during the overnight period of a day, an image 82 may be displayed on content display unit 25 during the morning drive-time period of a day, an image 83 may be displayed on content display unit 25 during the afternoon drive-time period of a day, and an image 84 may be displayed on content display unit 25 during the evening period of a day. It is also contemplated that a content display unit 25 may include only a portion capable of dynamic-content display, the remainder of content display unit 25 being incapable of dynamic-content display. This would be useful, for example, for updating numeric data such as lottery numbers or the like.

Figure 4:
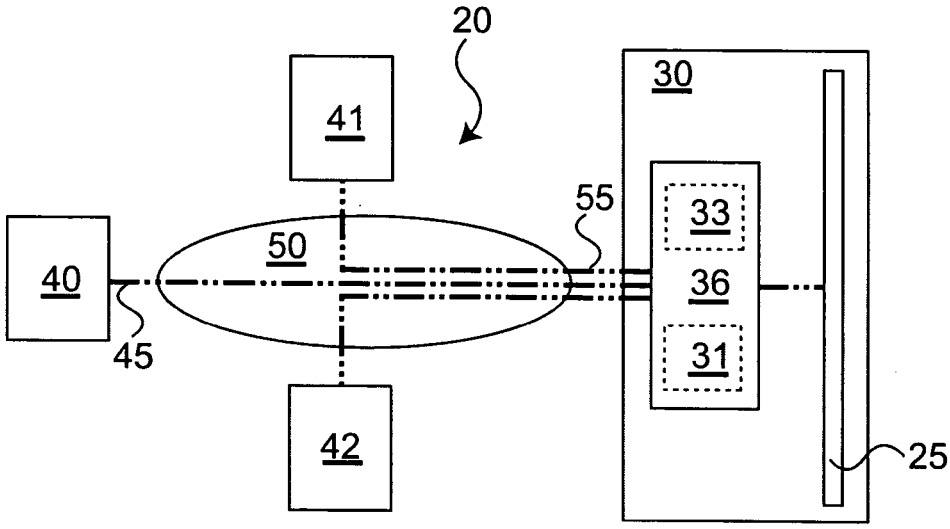
FIG. 4 is a block diagram of an advertising billboard system with a heirarchical control in accordance with the present invention.

FIG. 4 is a block diagram of an advertising billboard system 20 with a hierarchical control in accordance with the present invention. The display controller 30 may be adapted to receive, store, and display dynamic-content from a plurality of servers illustrated in FIG. 4 as server 40, a second server 41, and a third server 42. Display controller 30 comprises a hierarchical control scheme, the hierarchical control scheme adapted to select dynamic-content from one server of the plurality of servers for display on the content display unit 25. The hierarchical control scheme may be prioritized or heuristic. For example, server 40 may be a national host computer at a highest priority, second server 41 may be a regional host computer at a middle priority, and third server 42 may be a local host computer at a low priority. Since any or all servers may be transmitting dynamic-content at any time or simultaneously, the hierarchical control scheme will select which dynamic-content is displayed on content display unit 25 at any time.

Figure 5:
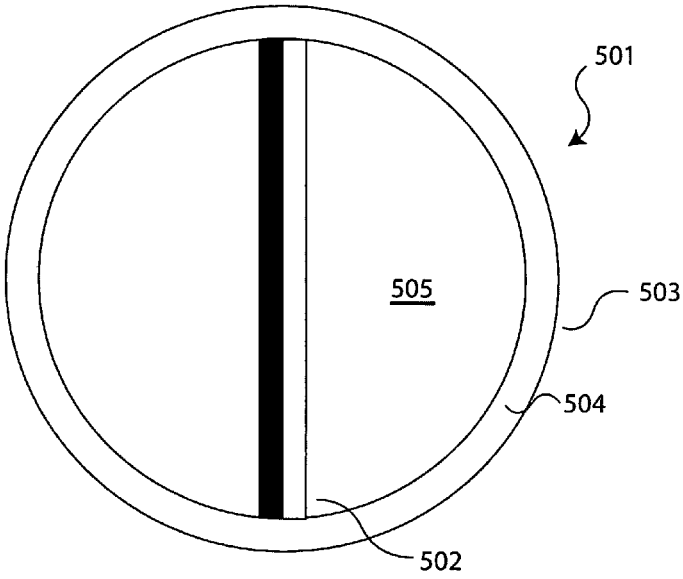
FIG. 5 is a top view of a single particle of passive display material with a color disk in edge-up position.

FIG. 5 is a top view of a single particle 501 of passive display material with a color disk 502 in edge-up position. Single particle 501 includes an outer shell 503, a liquid media 504, and a transparent sphere 505. Transparent sphere 505 rotates within outer shell 503 to present color disk 502 to the viewer, providing a single bit-depth of color information.

Figure 6A:
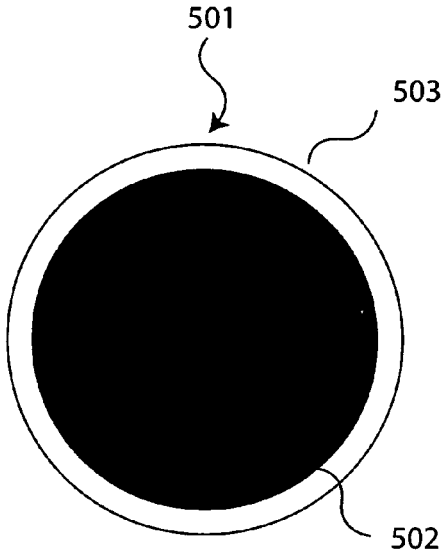
FIG. 6A is a top view of a single particle of passive display material with a color disk in black-up position.
Figure 6B:
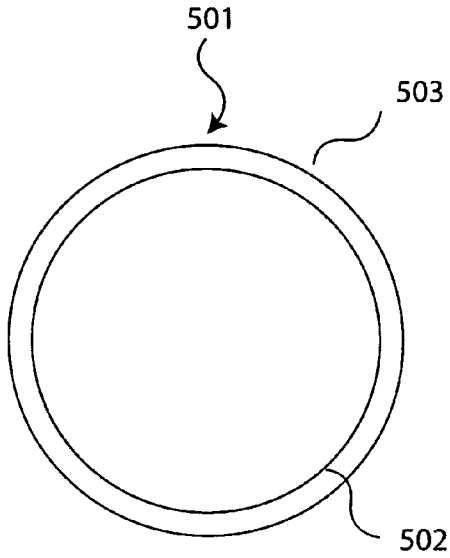
FIG. 6B is a top view of a single particle of passive display material with a color disk in white-up position.

FIG. 6A is a top view of single particle 501 of passive display material with color disk 502 in black-up position, and FIG. 6B is a top view of single particle 501 of passive display material with color disk 502 in white-up position.

Figure 7:
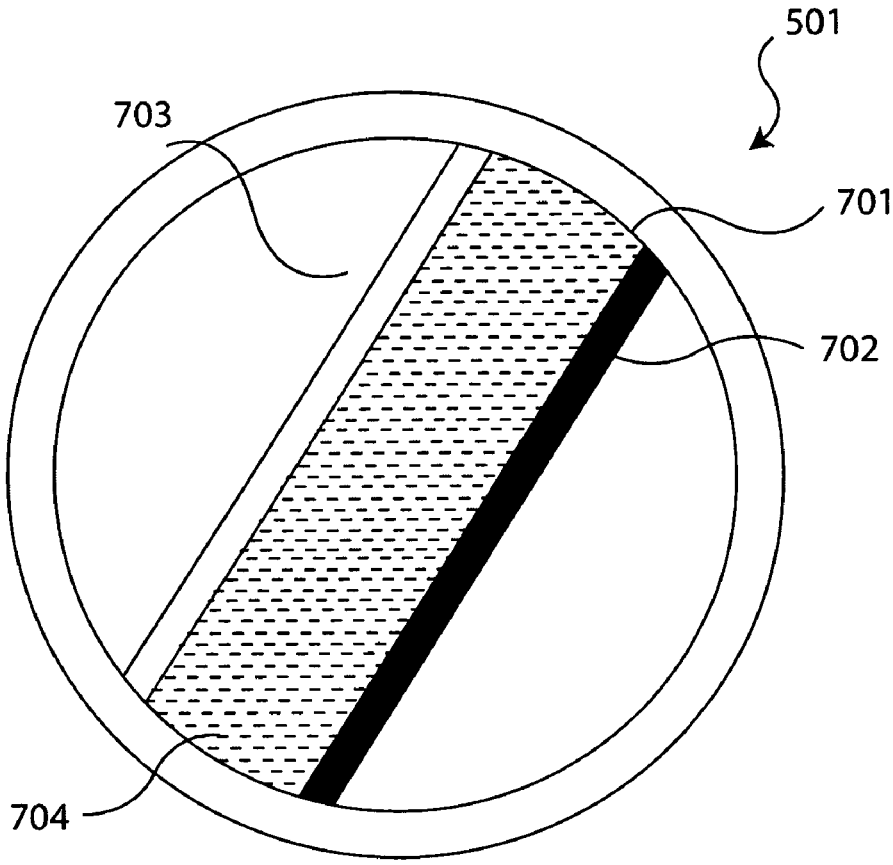
FIG. 7 is a top view of a single particle of passive display material with a 3-color disk in edge-up position.

FIG. 7 is a top view of single particle 501 of passive display material with a 3-color disk 701 in edge-up position. 3-color disk 701 includes a black portion 702, a white portion 703, and a gray portion 704. Gray portion 704 provides an additional ½ bit of information for presentation. Here, black, white, or gray may be selected for viewing.

Figure 8:
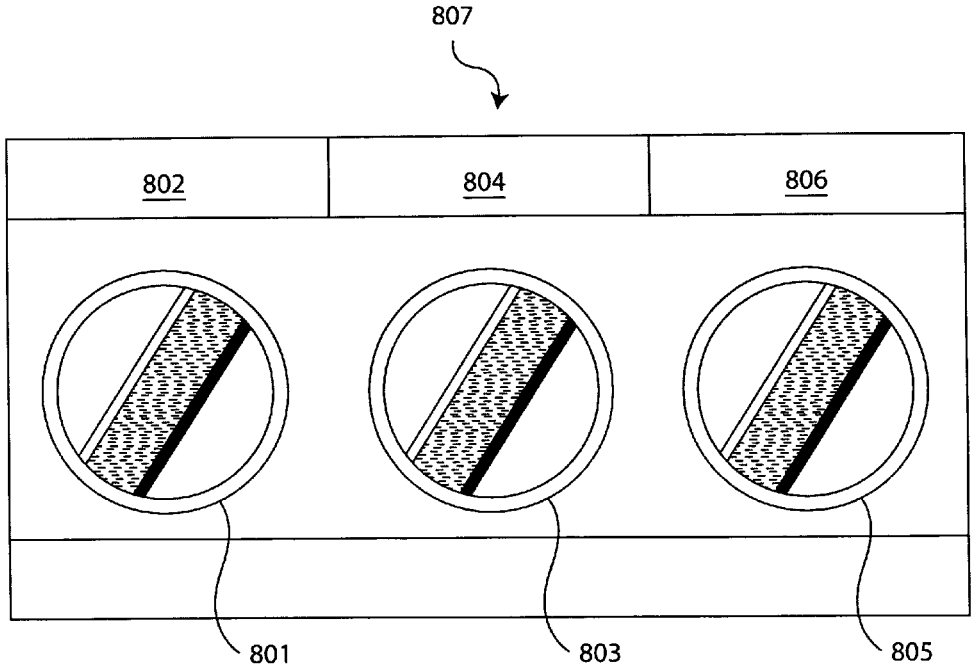
FIG. 8 is a side view of a passive display material with three 3-color disks.

FIG. 8 is a side view of a passive display material with three 3-color disks in accordance with the present invention, the three 3-color disks representing a single pixel 807 of image data. A first particle 801 resides under a first color filter 802. A second particle 803 resides under a second color filter 804. A third particle 805 resides under a third color filter 806. First color filter 802 may be, for example, red; second color filter 804 may be, for example, green; and third color filter 806 may be, for example, green. In this scheme color information may be presented to a viewer with a 1.5 bit-depth of each of three colors; red at three levels, green at three levels; and blue at three levels. This is similar to RGB color schemes employed by televisions and the like. However, normal RGB schemes provide for each element in the pixel to have multiple levels, providing significant available colors. For example, 8-bits of red, 8-bits of green, and 8-bits of blue provide $2^{24}$ colors, whereas the pixel illustrated in FIG. 8 only provides 27 colors.

Figure 9:
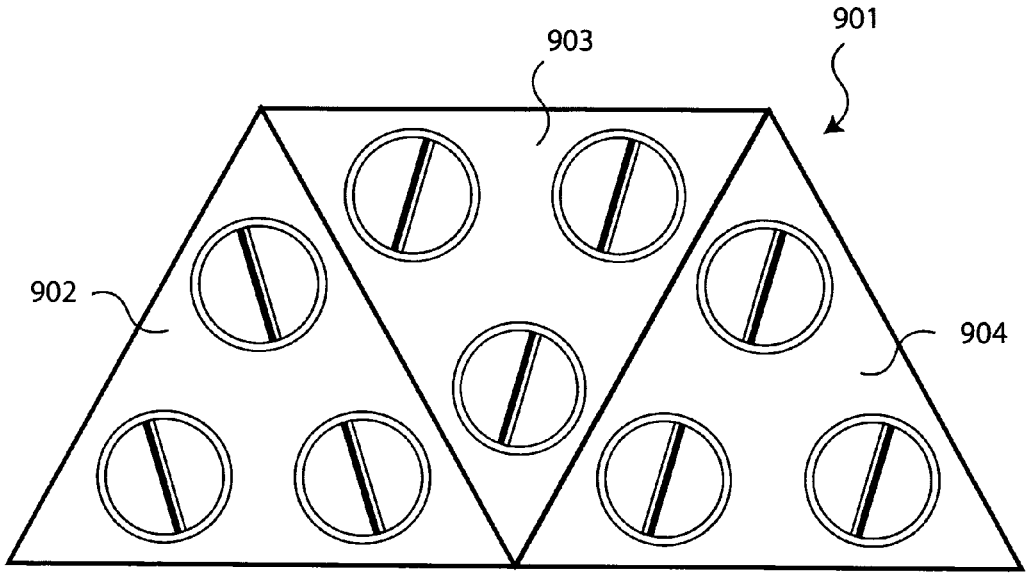
FIG. 9 is a top view of three pixels of binary passive display material.

FIG. 9 is a top view of one pixel 901 segmented into three colors, each color having three particles under a filter. A triangular section 902 may be, for example, red; a triangular section 903 may be, for example, blue; and a triangular section 903 may be, for example, green. Pixel 901 has the same number of colors available as the pixel illustrated in FIG. 8, however because pixel 901 has three particles per color, the intensity of the light viewed will be approximately three times the intensity of the light from pixel 807.

Figure 10:
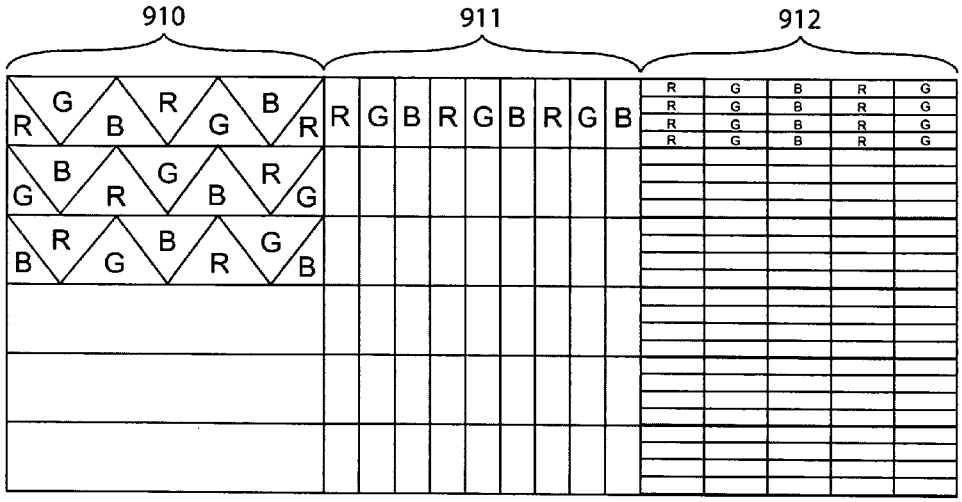
FIG. 10 is a section of passive display material with sub-pixels arranged to provide pseudo bit-depth color.

FIG. 10 is a section of passive display material with sub-pixels arranged to provide pseudo bit-depth color. FIG. 10 illustrates three pixels, pixel 910, pixel 911, and pixel 912. Pixel 901 includes 36 triangular color filters over 36 sub-pixels: 12 red, 12 green, and 12 blue. Pixel 911 includes 66 sub-pixels, and pixel 912 includes 30 sub-pixels, wherein each sub-pixel is also divided into 4 sub-sub-pixels. Pseudo bit-depth color schemes such as the three schemes illustrated here may be used to increase the apparent bit-depth of a display.

An entire display may be manufactured by, for example, printing color filters using pseudo bit depth color schemes over GYRICON. For example, if a display were made where each pixel of the display were divided into the pseudo bit-depth color scheme illustrated in FIG. 10 as pixel 910, a 1 bit display material will have an apparent bit depth corresponding to 12 levels each of red, green and blue, providing 1728 apparent colors.

Pseudo bit-depth color schemes work by providing pixel sizes equal to or better than the point-spread function (PSF) of the viewer. A viewer cannot discern the location of a source of light with better resolution than the PSF. The viewer will see the light intensity level from 1 sub-pixel or 12 sub-pixels within pixel 910 as originating from the same location, providing pseudo intensity variation.

Large scale displays need only from 2 to 25 pixels per inch for a viewer to consider the display to be high resolution. A billboard may use the extra resolution available under the viewers resolution limit to provide Pseudo bit-depth color schemes, improving the apparent dynamic range of colors.

Figure 11:
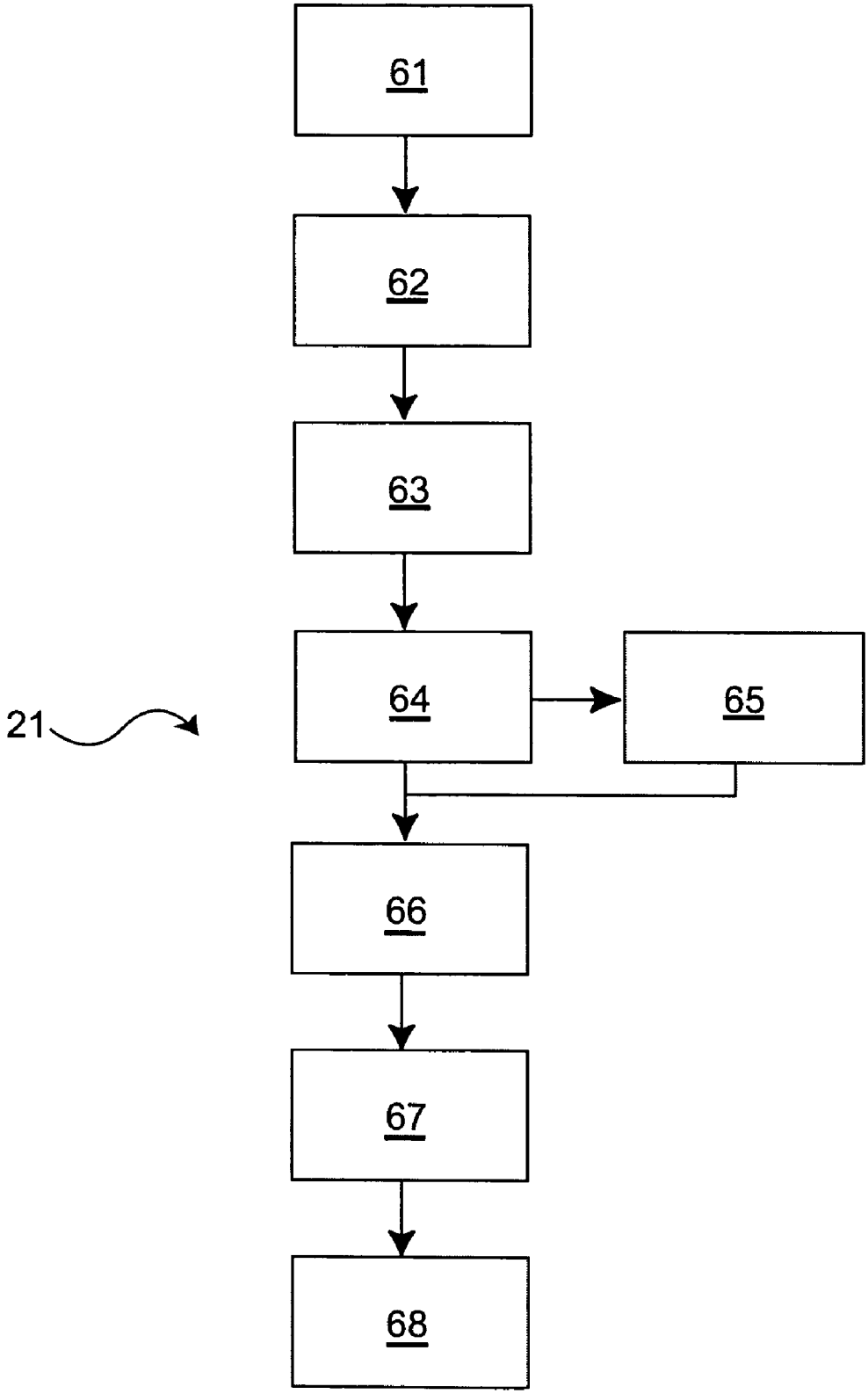
FIG. 11 is a flow chart illustrating a method of billboard advertising in accordance with the present invention.

FIG. 11 is a flow chart illustrating a business method 21 of billboard advertising in accordance with the present invention. The business method 21 for billboard advertising illustrated in FIG. 11 includes the following steps:

A) providing an advertising system, wherein the advertising system comprises:
   - at least one server;
   - at least one display controller, wherein the display controller is adapted to receive and display dynamic-content from the server; and
   - at least one content display unit in communication with the display controller, wherein the content display unit visually displays the information from the dynamic-content;(illustrated as step 61)

B) receiving advertising information from an advertiser; (illustrated as step 62)

C) communicating the advertising information as dynamic-content to the display controller, wherein said advertising information comprises pseudo bit-depth sub-pixels;(illustrated as step 63)

D) displaying the advertising information on the content display unit.(illustrated as step 64) In step D, the displaying step may be divided into a plurality of time segments, allowing the step of: displaying a first advertisement during a first time segment and displaying a second advertisement during a second time segment. (illustrated as step 65)

E) segmenting a plurality of content display units into a plurality of groups, each group from the plurality of groups identified with a characteristic;(illustrated as step 66)

F) selecting a group from the plurality of groups to display dynamic-content on the plurality of content display units having the group characteristic.(illustrated as step 67) In step A, a plurality of servers may be provided, and the business method may further comprise:

G) selecting a heirarchy, the heirarchy defining a prioritization of the plurality of servers to at least one of the display controllers such that the display controller selects one server from the plurality of servers.(illustrated as step 68)

Illustrations of method steps, such as, for example, the steps illustrated in FIG. 11, show steps sequentially and in a particular order. There is no need to perform the steps in the order illustrated. Deviating from the illustrated order for some or all of the steps is contemplated by the inventor, and does not depart from the scope of the present invention.

Each feature disclosed in this specification (including any accompanying claims, abstract, and drawings), may be replaced by alternative features having the same, equivalent or similar purpose, unless expressly stated otherwise. Thus, unless expressly stated otherwise, each feature disclosed is one example only of a generic series of equivalent or similar features.

While preferred embodiments of the present invention have been shown and described herein, it will be obvious to those skilled in the art that such embodiments are provided by way of example only. Numerous variations, changes, and substitutions will be apparent to those skilled in the art without departing from the invention. Accordingly, it is intended that the invention be limited only by the spirit and scope of the appended claims.

What is claimed is:

1. An advertising billboard device comprising:

a plurality of servers, wherein the servers of said plurality of servers store dynamic content;

a display controller in communication with said plurality of servers, wherein said display controller comprises a hierarchical control scheme, wherein said hierarchical control scheme defines a prioritization of said plurality of servers, wherein said display controller is adapted to receive and display dynamic-content from a server selected according to the hierarchical control scheme; and at least one passive content display unit in communication with said display controller, wherein said passive content display unit visually displays the information from said dynamic-content, wherein said passive content display unit comprises a pseudo bit-depth color scheme.

2. The advertising billboard device of claim 1, wherein said passive content-display unit comprises GYRICON.

3. The advertising billboard device of claim 1, wherein said passive content-display unit comprises E-INK.

4. The advertising billboard device of claim 1, wherein said pseudo bit-depth color scheme comprises a plurality of red, green, and blue filters superimposed over single bit-depth display material.

5. The advertising billboard device of claim 4, wherein said single bit-depth material is GYRICON.

6. The advertising billboard device of claim 4, wherein said single bit-depth material is E-INK.

7. The advertising billboard device of claim 1, wherein the hierarchical control scheme is heuristic.

8. The advertising billboard device of claim 1, wherein passive content display unit comprises:

a plurality of multi-colored particles, wherein each multi-colored particle of the plurality of multi-colored particles comprises a black portion, a white portion, and a gray portion, wherein each multi-colored particle of the plurality of multi-colored particles is configured to permit the selective display of black, white, or gray, and a plurality of color filters, wherein each color filter of the plurality of color filters is positioned over one or more multi-colored particles of the plurality of multi-colored particles, wherein the combination of multi-colored particles and respective color filters is operable to render the pseudo bit-depth color scheme.

9. An advertising billboard system comprising:

a plurality of servers, wherein the servers of said plurality of servers store dynamic content;

a plurality of display controllers, wherein each of said plurality of display controllers is adapted to receive and display dynamic-content from at least one of said plurality of servers, wherein said dynamic-content is divided into sub-pixels forming a pseudo bit-depth color scheme;

at least one content display unit in communication with each of said plurality of display controllers, wherein said at least one content display unit visually displays the information from said dynamic-content; said advertising billboard system comprising a timing means, wherein at least one of said plurality of display controllers alters the visual display of said at least one content display unit as a function of the time from said timing means; and wherein at least one of said plurality of display controllers is adapted to receive, store, and display dynamic-content from at least two of said plurality of servers, wherein said at least one of said plurality of display controllers comprises a hierarchical control scheme, wherein said hierarchical control scheme defines a prioritization of the plurality of servers to at least one of the display controllers, wherein the display controller is configured to select a server from said plurality of servers in accordance with the hierarchical control scheme.

10. The advertising billboard system of claim 9, wherein said at least one content display unit is passive.

11. The advertising billboard system of claim 10, wherein said at least one content display unit comprises GYRICON.

12. The advertising billboard system of claim 10, wherein said at least one content display unit comprises E-INK.

13. A method of displaying dynamic content comprising the steps of:

A) providing a content display unit;

B) providing a plurality of servers, wherein each server of the plurality of servers has a digital image;

C) providing a hierarchical control scheme, wherein the hierarchical control scheme defines a prioritization of the plurality of servers;

D) selecting a server from the plurality of servers in accordance with the hierarchical control scheme;

E) retrieving a digital image from the selected server, wherein the retrieved digital image has single pixels having bit-depth;

F) converting the retrieved digital image from single pixels having bit-depth to a multiple pixel pseudo-bit-depth format;

G) displaying said converted multiple pixel pseudo-bit-depth format image on said content display unit.

14. The method of claim 13 wherein in step F, a pixel having an integer n bit-depth is converted to $2^n$ pixels.

15. The method of claim 14, wherein said pseudo bit-depth format comprises a plurality of red, green, and blue filters superimposed over single bit-depth display material.

16. The method of claim 15, wherein said single bit-depth material is GYRICON.

17. The method of claim 15, wherein said single bit-depth material is E-INK.

18. The method of claim 13, wherein said pseudo bit-depth format comprises a plurality of red, green, and blue filters superimposed over single bit-depth display material.

19. The method of claim 18, wherein said single bit-depth material is GYRICON.

20. The method of claim 18, wherein said single bit-depth material is E-INK.

* * * * *